US007841374B2

(12) United States Patent
Berk

(10) Patent No.: US 7,841,374 B2
(45) Date of Patent: Nov. 30, 2010

(54) METHOD AND APPARATUS FOR PROVIDING A SHOULDER BAG ATTACHMENT

(76) Inventor: Joseph Berk, 9199 Reisterstown Rd., Suite 207A, Owing Mills, MD (US) 21117

( * ) Notice: Subject to any disclaimer, the term of this patent is extended or adjusted under 35 U.S.C. 154(b) by 230 days.

(21) Appl. No.: 11/937,877

(22) Filed: Nov. 9, 2007

(65) Prior Publication Data

US 2009/0120546 A1 May 14, 2009

(51) Int. Cl.
*A45C 5/14* (2006.01)

(52) U.S. Cl. ..... 150/106; 150/100; 150/113; 190/102

(58) Field of Classification Search ..... 150/106, 150/100, 105, 104, 111, 113; 206/315.9, 206/214

See application file for complete search history.

(56) References Cited

U.S. PATENT DOCUMENTS

| | | | | | |
|---|---|---|---|---|---|
| 2,089,670 | A | * | 8/1937 | Snyder | 383/10 |
| 2,646,833 | A | * | 7/1953 | Meyers | 150/112 |
| 2,784,757 | A | * | 3/1957 | Bosca et al. | 150/138 |
| 3,354,925 | A | * | 11/1967 | Doppelt | 150/108 |
| 4,068,786 | A | * | 1/1978 | Taniguchi | 224/577 |
| D253,165 | S | * | 10/1979 | Scott | D8/396 |
| 4,700,761 | A | * | 10/1987 | Gladding | 150/111 |
| 5,050,713 | A | | 9/1991 | Lee | |
| 5,251,743 | A | * | 10/1993 | Pulido et al. | 206/38.1 |
| 5,402,869 | A | | 4/1995 | Saltzman et al. | |
| 5,489,021 | A | * | 2/1996 | Wallingford | 206/214 |
| 5,713,439 | A | * | 2/1998 | Zionts et al. | 190/102 |
| 6,092,574 | A | * | 7/2000 | Krulik | 150/110 |
| 6,152,343 | A | * | 11/2000 | Shin | 224/645 |
| 6,230,771 | B1 | | 5/2001 | Hellenbrand | |
| D500,590 | S | * | 1/2005 | Sachen | D3/216 |
| D569,611 | S | * | 5/2008 | Gerbi | D3/246 |
| 2006/0011687 | A1 | * | 1/2006 | Wadley et al. | 224/587 |
| 2008/0142557 | A1 | * | 6/2008 | Hess et al. | 224/264 |

* cited by examiner

*Primary Examiner*—Anthony Stashick
*Assistant Examiner*—Cynthia F Collado
(74) *Attorney, Agent, or Firm*—The Marbury Law Group PLLC

(57) ABSTRACT

An auxiliary storage accessory for use with shoulder bags releasably attaches to the attachment points of the shoulder strap on the shoulder bag with elastic straps in order to be usable with a variety of shoulder bags. The storage accessory is typically an auxiliary bag. The storage accessory is removable and can include a storage compartment and/or item holders such as pockets, straps, clips, hooks, loops, and combinations thereof.

16 Claims, 3 Drawing Sheets

METHOD AND APPARATUS FOR PROVIDING A SHOULDER BAG ATTACHMENT

BACKGROUND OF THE INVENTION

The present invention relates to increasing the utility of shoulder-carried bags and luggage by use of an auxiliary attachment or bag that attaches to the strap-attachment points of the shoulder-carried bag or luggage.

Shoulder-carried bags and luggage (hereinafter referred to as "bags") are commonly used by travelers and are also used by business persons as laptop carriers and briefcases. In use, these bags are supported at the side of a user by a strap that drapes over the user's shoulder (i.e., a shoulder strap). As such, the bags will typically rest against the user's hip or waist. If the bags are overstuffed, the sides will often bow outwards, moving the center of gravity further from the user, thus transmitting forces through the strap that tend to pull the strap off of the user's shoulder, which makes the bag uncomfortably difficult to carry. Additionally, the bowed sides can cause the bag to twist and bounce off of the user while they walk.

To avoid some of these problems caused by overstuffing, some shoulder bags will limit the expansion ability of the bag to keep the sides from bowing outwardly. While it solves some of the problems caused by overstuffing, the user is limited to the existing capacity of the bag and must carry other items in some other manner.

Various attempts have been made to address these problems in the prior art. U.S. Pat. No. 5,050,713 to Lee for a "Travel Bag" discloses the use of upper hook-and-loop fasteners and lowers straps with snap fasteners to attach add-on bags to a shoulder bag. The specific nature of the attachments limits the system to use of the add-on bag with the corresponding shoulder bag.

U.S. Pat. No. 5,402,869 to Saltzman et al. for a "Main Carrying Bag with Detachable Secondary Bag" discloses a system wherein a secondary bag is zippered to a main bag. Again, the specific nature of the attachments limits the system to use of the secondary bag with the corresponding main bag.

U.S. Pat. No. 6,230,771 to Hellenbrand for a "Modular Carry-All Assembly" discloses a secondary bag strapped to a primary bag, with both bags having shoulder straps.

U.S. Pat. No. Des. 500,590 to Sachen for a "Diaper Bag/Backpack with Removable Shoulder Bag" discloses a main pack that allows a purse or similar pouch to be clipped onto a mid/lower portion.

What would be useful is an auxiliary attachment or bag with an elastic attachment system that can be attached to virtually any shoulder bag and which provides additional means for carrying articles.

BRIEF SUMMARY OF THE INVENTION

Embodiments of the present invention provide an auxiliary attachment or bag that uses elastic straps that extend from the upper corners and terminate with fasteners to attach to the shoulder strap attachment location on an existing shoulder bag. The elastic straps allow the auxiliary attachment or bag to be attached to variously-sized shoulder bags. In exemplary embodiments, the upper edge of the auxiliary attachment or bag includes a stiffening member. The stiffening member keeps the auxiliary attachment or bag from sagging and combines with the elastic straps to allow the upper edge to be pulled away from the shoulder bag in order to drape clothing and similar items over the upper edge.

The auxiliary attachment or bag can provide additional utility to shoulder bags by providing pockets, straps, loops and hooks for engaging or holding commonly carried items such as cellphones, PDAs, iPods® or other media players, travel umbrellas, shopping bags, water bottles, writing utensils, business cards, etc. The auxiliary attachment or bag may be made of lightweight material, such as nylon or canvas, and comprise both a bag and storage attachments for items on an exterior side of the bag.

Various means can be used to releasably secure the auxiliary attachment or bag to the shoulder bag, but in most cases the auxiliary attachment or bag can use the same type of attachment means as used by the straps of the shoulder bag since these straps are usually releasably removable via conventional spring-biased clips or the like.

DETAILED DESCRIPTION OF THE INVENTION

Figure 1:
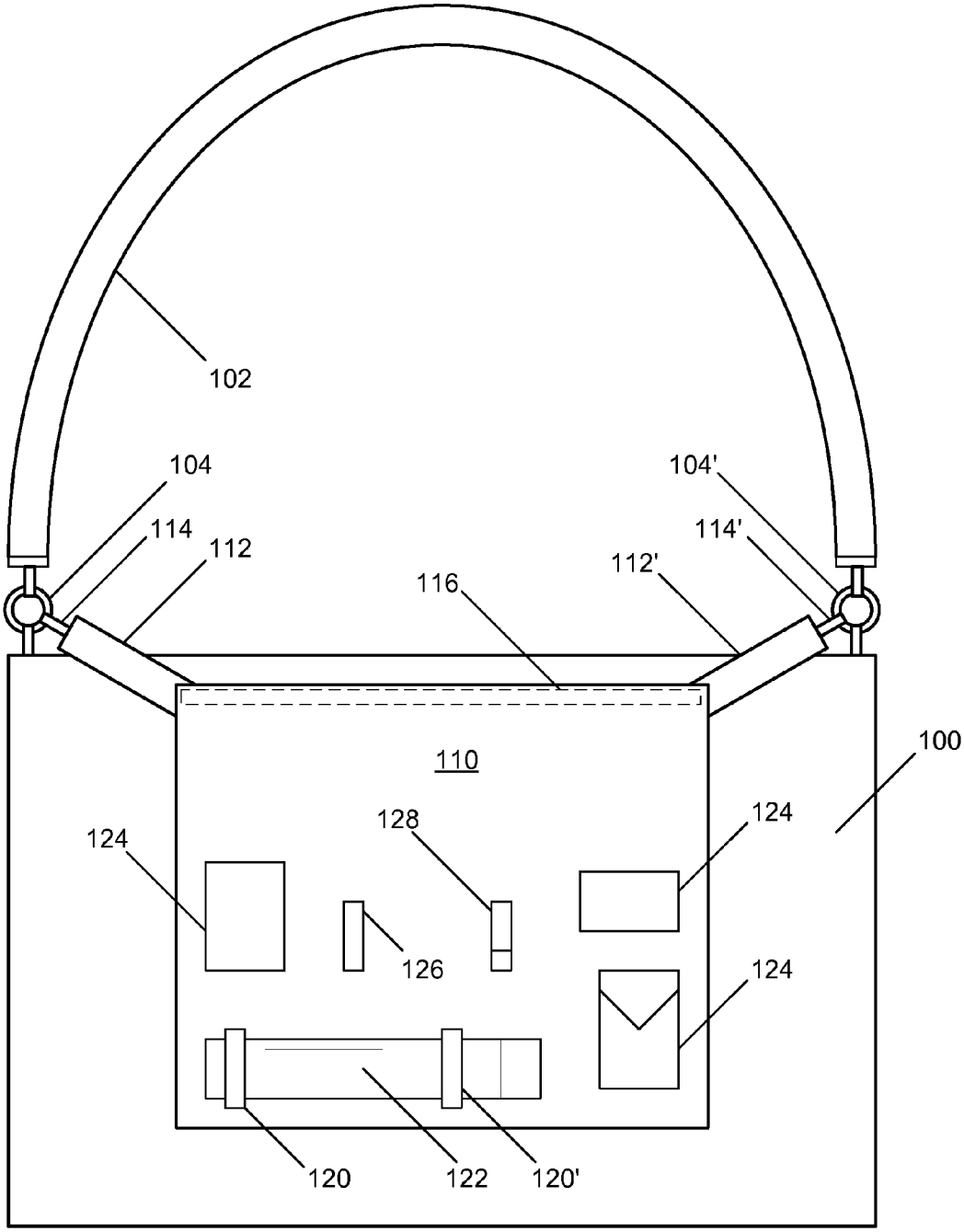
FIG. 1 illustrates an embodiment with a storage attachment mounted on a shoulder bag.

FIG. 1 illustrates an embodiment of an auxiliary attachment 110 releasably secured to a shoulder bag 100. Shoulder bag 100 includes a shoulder strap 102 connected to strap attachment points 104, 104'. Although illustrated as circular rings, attachment points 104, 104' can take various other forms, including but not limited to D-rings, buckles, loops, and integral metal grommets. While auxiliary attachment 110 will typically be an auxiliary bag with one or more primary storage compartments, the auxiliary attachment 110 can also merely comprise a base for supporting item carriers, without any primary storage compartment.

Auxiliary attachment 110 is secured to shoulder bag 100 by first and second portions of elastic strap 112, 112' that extend from either end of an upper edge of the auxiliary attachment 110. The portions of elastic strap 112, 112' terminate with fastening means 114, 114' that are used to releasably attach the portions of elastic strap 112, 112' to shoulder strap attachment points 104, 104'. While these fastening means will typically be spring-biased clips, nearly any means that is used for releasably attaching shoulder straps to a shoulder bag can be used as the fastening means.

In an exemplary embodiment disclosed in FIG. 1, a stiffening member 116 is incorporated into the upper edge or margin of auxiliary attachment 110. Such a stiffening member 116 can be made of rigid polymer (plastic), wood, carbon fiber, or lightweight metal, and can be incorporated by any suitable method, including but not limited to adhesive, fasteners, and sewn or bonded pockets. The stiffening member 116 prevents the auxiliary attachment 110 from sagging and further cooperates with straps 112, 112' to allow items to be carried by being draped over the top of the auxiliary attachment 110. This is done by pulling the auxiliary attachment 110 horizontally away from the shoulder bag 100, draping the item over the top of auxiliary attachment 110, and releasing the auxiliary attachment 110 so as to let the elastic straps 112, 112' apply some horizontal force to the item, which is further supported against the forces of gravity by the strength of the stiffening member 116.

The auxiliary attachment 110 can also include various item carrying means. FIG. 1 illustrates one exemplary embodiment having straps 120, 120' holding an umbrella 122, various pockets 124 for cellphones, PDAs, MP3 players, business cards, and the like, a hook 126 for shopping bags, camera straps, and the like, and a loop 128 for attachment of items having their own clips. Of course, the variations for configurations of conventional item carrying means is nearly endless and limited only by practical weight limits and the imagination of the designer. Indeed, for shopping bags having a looped handle, camera straps, and the like, one of ordinary skill in the art will readily understand that the function of a hook 126 can also be accomplished by the straps 112, 112' and fasteners 114, 114' by running straps 112, 112' through the handle or strap to support the item in the manner of hook 126. Additionally or alternately, hooks 126 and loops 128 can also be located on straps 112, 112' or integral with fasteners 114, 144'.

Figure 2:
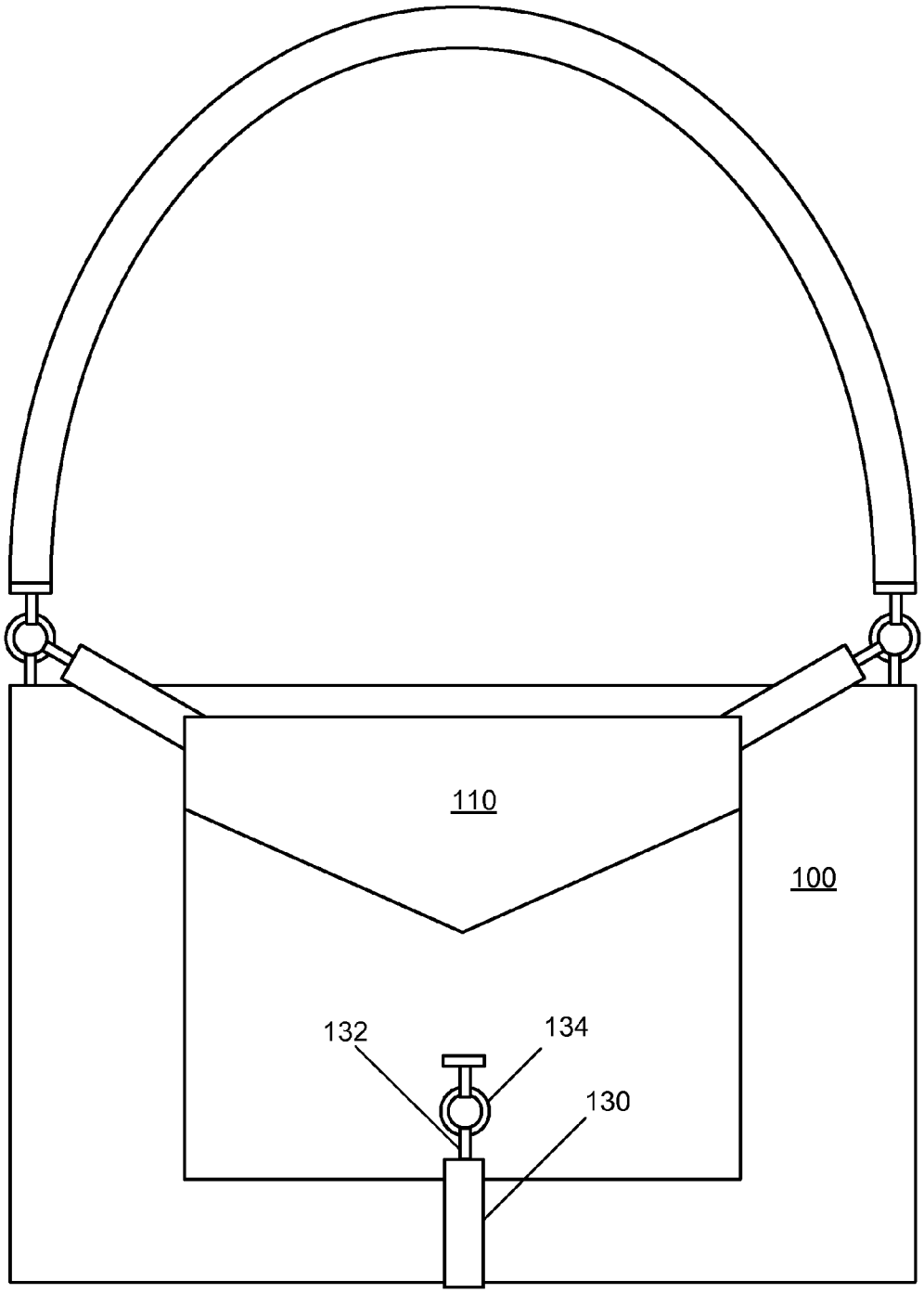
FIG. 2 illustrates an embodiment with an elastic strap securing a lower end of a storage attachment in the form of an auxiliary bag.
Figure 3:
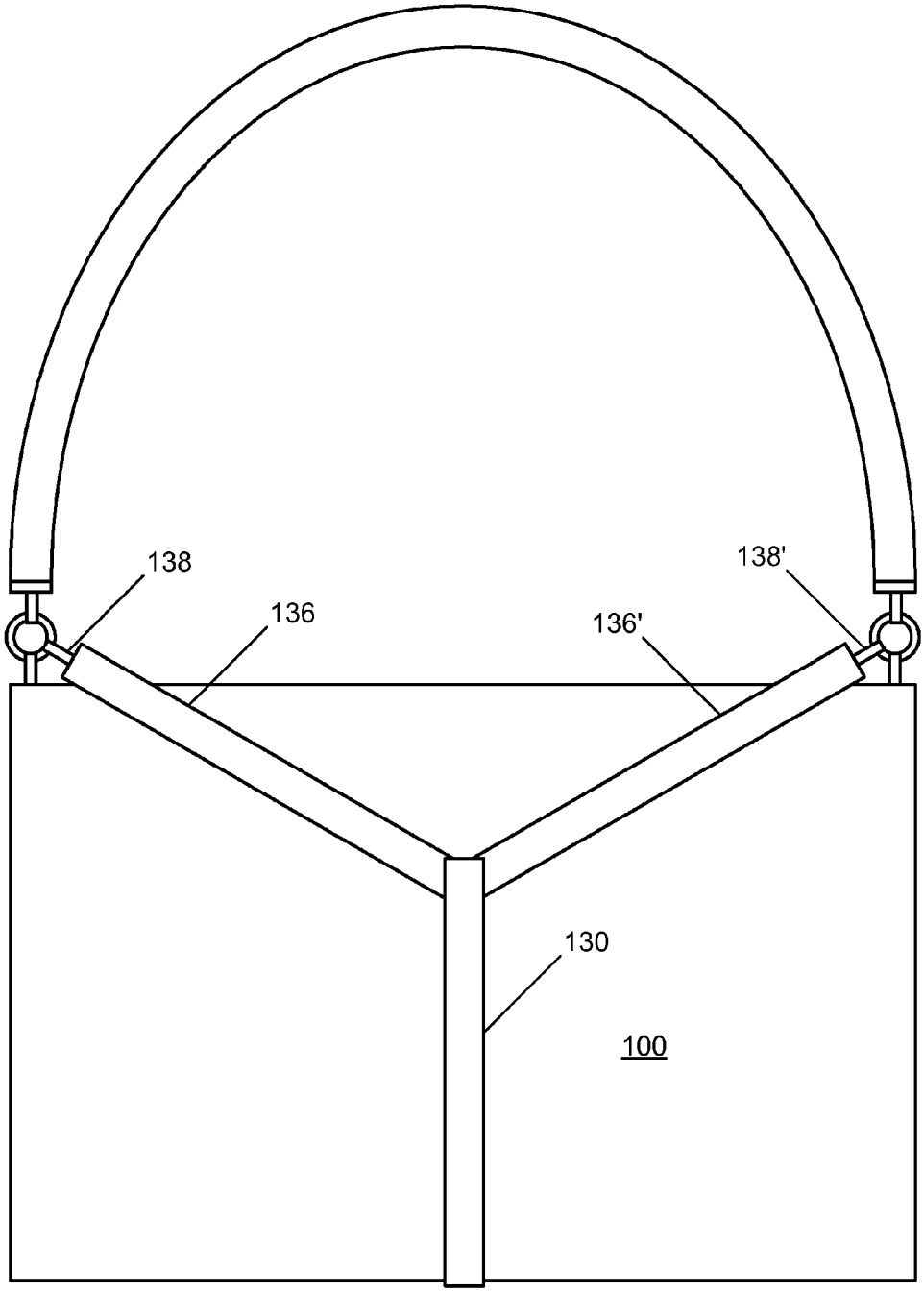
FIG. 3 illustrates a back side of a shoulder bag in the embodiment of FIG. 2.

FIG. 2 illustrates an embodiment where auxiliary attachment 110 takes the form of an auxiliary bag that has one or more storage compartments. The auxiliary bag 110 can optionally include a conventional strap retention point 134, illustrated in this example as a ring attached to a lower central portion of the auxiliary bag 110. The retention point 134 is used in conjunction with a retention strap 130 and releasable fastening means 132 to prevent the auxiliary bag 110 from swinging. In a preferred embodiment that allows use with various shoulder bags, the retention strap 130 is elastic and splits into a Y-shape with elastic straps 136, 136' to attach to the shoulder strap retention points with releasable fastening means 138, 138' from a backside of shoulder bag 110, as illustrated in FIG. 3.

Although, for purposes of illustration, the auxiliary attachment 110 has been shown as smaller than the shoulder bag 100, in use the auxiliary attachment 110 will typically be similar in size to the shoulder bag 100 and can be smaller, the same size, or larger than the shoulder bag 100.

Elastic straps 112, 112' can be separate portions of strap attached to the corners of the auxiliary attachment 110 or can be portions of the same strap that is secured to an upper central portion of the auxiliary attachment 110 and routed through means at the corners of the auxiliary attachment 110. While described herein as "straps" and illustrated as flat, the straps are not limited to any particular cross-sectional shape or configuration and, without limitation, may be flat straps, braided flat straps, multiple parallel flat straps, substantially round cords (such as used with "bungee cords"), braided cords, or multiple parallel cords.

A method and apparatus for providing an auxiliary attachment for a shoulder bag have been described. It will be understood by those skilled in the art that the present invention may be embodied in other specific forms without departing from the scope of the invention disclosed and that the examples and embodiments described herein are in all respects illustrative and not restrictive. Those skilled in the art of the present invention will recognize that other embodiments using the concepts described herein are also possible. Further, any reference to claim elements in the singular, for example, using the articles "a," "an," or "the" is not to be construed as limiting the element to the singular.

What is claimed is:

1. A shoulder bag attachment, comprising:

an auxiliary storage attachment, comprising:

an upper edge having a first end and a second end;

at least one storage means below the upper edge; and a retention point located on a lower central portion;

a first portion of elastic strap extending from the first end of the upper edge and terminating with a fastening means dimensioned to engage a first attachment point of a strap on a shoulder bag;

a second portion of elastic strap extending from the second end of the upper edge and terminating with a fastening means dimensioned to engage a second attachment point of the strap on the shoulder bag; and a retention strap comprising:

a releasable fastening means for engaging the retention point of the auxiliary attachment;

an elastic strap attached to the releasable fastening means and dimensioned to extend below the shoulder bag to a backside of the shoulder bag and split into a Y-shape pair of elastic straps; and releasable fastening means attached to ends of the Y-shaped pair of elastic straps and dimensioned to engage the first and second attachment points of the strap on the shoulder bag;

wherein the upper edge of the auxiliary attachment further comprises a stiffening member.

2. The shoulder bag attachment of claim 1, wherein the auxiliary attachment comprises an auxiliary bag comprising at least one storage compartment.

3. The shoulder bag attachment of claim 1, wherein the stiffening member is a lightweight metal bar.

4. The shoulder bag attachment of claim 1, wherein the storage means of the auxiliary attachment further comprises a combination of item holders selected from the group consisting of straps, loops, pockets, clips, and hooks.

5. The shoulder bag attachment of claim 2, wherein the auxiliary bag further comprises a combination of item holders selected from the group consisting of straps, loops, pockets, clips, and hooks.

6. The shoulder bag attachment of claim 1, wherein the first and second portions of elastic strap are individual straps.

7. The shoulder bag attachment of claim 1, wherein the first and second portions of elastic strap are portions of a unitary elastic strap.

8. The shoulder bag attachment of claim 1, wherein the fastening means are selected from the group consisting of clips, loops, straps, and hooks.

9. A method of providing an auxiliary storage attachment to a shoulder bag, comprising:

providing at least one storage means on the auxiliary storage attachment, wherein the auxiliary storage attachment comprises:

an upper edge comprising a first end, a second end, and a stiffening member therebetween;

at least one storage means below the upper edge; and a retention point located on a lower central portion;

removably fastening a first portion of elastic strap between the first end of the upper edge of the storage attachment and a first shoulder strap attachment point on the shoulder bag;

removably fastening a second portion of elastic strap between the second end of an upper edge of the storage attachment and a second shoulder strap attachment point on the shoulder bag; and removably fastening a retention strap to the retention point of the auxiliary attachment, the retention strap dimensioned to extend below the shoulder bag to a backside of the shoulder bag and split into a Y-shape pair of elastic straps; and removably fastening ends of the Y-shaped pair of elastic straps to the first and second attachment points of the strap on the shoulder bag.

10. The method of providing a storage attachment to a shoulder bag of claim 9, further comprising providing the auxiliary storage attachment as an auxiliary bag with at least one storage compartment.

11. The method of providing a storage attachment to a shoulder bag of claim 9, further comprising providing a lightweight metal bar as the stiffening member in the upper edge of the storage attachment.

12. The method of providing a storage attachment to a shoulder bag of claim 9, further comprising providing the storage attachment with a combination of item holders selected from the group consisting of straps, loops, pockets, clips, and hooks.

13. The method of providing a storage attachment to a shoulder bag of claim 10, further comprising providing the auxiliary bag with a combination of item holders selected from the group consisting of straps, loops, pockets, clips, and hooks.

14. The method of providing a storage attachment to a shoulder bag of claim 9, further comprising pulling the stiffening member away from the storage attachment and draping an item to be stored over the stiffening member.

15. The method of providing a storage attachment to a shoulder bag of claim 11, further comprising pulling the lightweight metal bar away from the storage attachment and draping an item to be stored over the lightweight metal bar.

16. The method of providing a storage attachment to a shoulder bag of claim 9, removably fastening the first and second portion of elastic strap, the retention strap, and the Y-shaped pair of elastic straps with a fastener selected from the group consisting of clips, loops, straps, and hooks.

* * * * *